US005735399A

United States Patent [19]

Ste. Marie

[11] Patent Number: 5,735,399

[45] Date of Patent: Apr. 7, 1998

[54] PAINT TRAY

[76] Inventor: Ray M. Ste. Marie, P.O. Box 6133, Brookings, Oreg. 97415

[21] Appl. No.: 656,981

[22] Filed: Jun. 6, 1996

[51] Int. Cl.[6] ..... B65D 1/36; B44D 3/12; B05C 21/00

[52] U.S. Cl. ..... 206/362; 220/501; 220/555

[58] Field of Search ..... 206/361, 362, 206/15.2, 15.3; 220/501, 555, 556

[56] References Cited

U.S. PATENT DOCUMENTS

| | | | |
|---|---|---|---|
| 2,661,858 | 12/1953 | Howell | 220/501 X |
| 2,669,736 | 2/1954 | Wabnitz | 220/501 X |
| 2,784,434 | 3/1957 | Little | 220/555 X |
| 3,837,034 | 9/1974 | Leffert et al. | 206/362 X |
| 4,010,866 | 3/1977 | McClane | 220/555 X |
| 4,266,746 | 5/1981 | Klaiber | 248/113 |
| 4,815,604 | 3/1989 | O'Neil et al. | 206/518 |
| 4,854,470 | 8/1989 | Ireland | 206/361 X |
| 4,993,671 | 2/1991 | Ste. Marie | 248/113 |

*Primary Examiner*—Jacob K. Ackun
*Attorney, Agent, or Firm*—David P. Campbell; Glenn D. Bellamy

[57] ABSTRACT

A paint tray 10 having a main paint well (12) and pair of side paint wells (14, 16), with each paint well including a sloped floor with ribbing for applying paint to the sleeve of a paint roller, and further comprising a pair of clamps, one for each side paint well (14, 16) for securing the handle of a paint brush or paint roller. The main paint well includes a deep end (18), and side paint wells (14, 16) include deep well areas (48) that are each contiguous with the deep end (18) of the main paint well, to allow paint from the side paint wells to mix with paint in the main paint well.

18 Claims, 2 Drawing Sheets

PAINT TRAY

TECHNICAL FIELD

This invention pertains to a paint tray and, more particularly, to a combination paint roller and paint brush tray and holder.

BACKGROUND OF THE INVENTION

Paint roller trays have been used for a long time to provide an easy device for applying paint to a roller pad. Such trays have a deep well section and a sloped section with ribs leading from a shallow end into the deep well. Paint accumulates in the deep well end and allows a painter to dip a roller pad into the accumulated paint and apply it evenly across the roller pad by rolling the pad along the sloped section of the paint tray.

While such trays have proved to be quite useful with paint rollers, a painter typically also uses a paint brush at the same time as using a paint roller. However, paint trays are not generally designed to hold paint brushes. Many painters simply keep a paint brush in a separate can of paint.

The present invention is designed to provide an improved paint roller tray that makes it easier for a painter to manipulate both a paint roller and a paint brush at the same time.

DISCLOSURE OF THE INVENTION

Briefly described, the present invention comprises a paint tray having a main paint well with a deep end and a shallow end. Sidewalls define the main paint well. The shallow end is designed to remove paint from a paint roller as the paint roller is rolled in the shallow end. The deep end is designed to hold a quantity of paint into which a paint roller can be dipped. The paint tray further includes a side paint well adjacent the deep end of the main paint well. The side paint well includes a paint instrument holder for holding an instrument such as a paint brush or small paint roller. The side paint well has a deep well area contiguous with the deep end of the main paint well. This allows paint in the two deep wells to mix.

The paint instrument holder includes a spring clamp for gripping a handle of a paint instrument. The spring clamp includes a pair of tines, each tine having a knobule at its distal end, for holding a paint instrument down on the holder.

Preferably, the side paint well is aligned parallel to the main paint well with the paint instrument holder adjacent a sidewall of the main paint well. However, the side paint well could be aligned at a right angle to the main paint well, but this design could be more difficult to use, especially in tight situations.

In a preferred embodiment, the paint tray includes a second side paint well opposite the first paint well. The second paint well includes a paint instrument holder and has a deep well area contiguous with the deep end of the main paint well, just like the first side paint well. In fact, the two side paint wells are mirror images of each other.

According to an aspect of the invention, the paint tray further includes a clamp at the shallow end of the main paint well for securing the main paint well to a rung of a ladder.

These and other advantages and features will become apparent from the following detailed description of the best mode for carrying out the invention and the accompanying drawings, and the claims, which are incorporated herein as part of the disclosure of the invention.

BRIEF DESCRIPTION OF THE DRAWINGS

Like reference numerals refer to like parts throughout the several views, wherein.

BEST MODE FOR CARRYING OUT THE INVENTION

Figure 1:
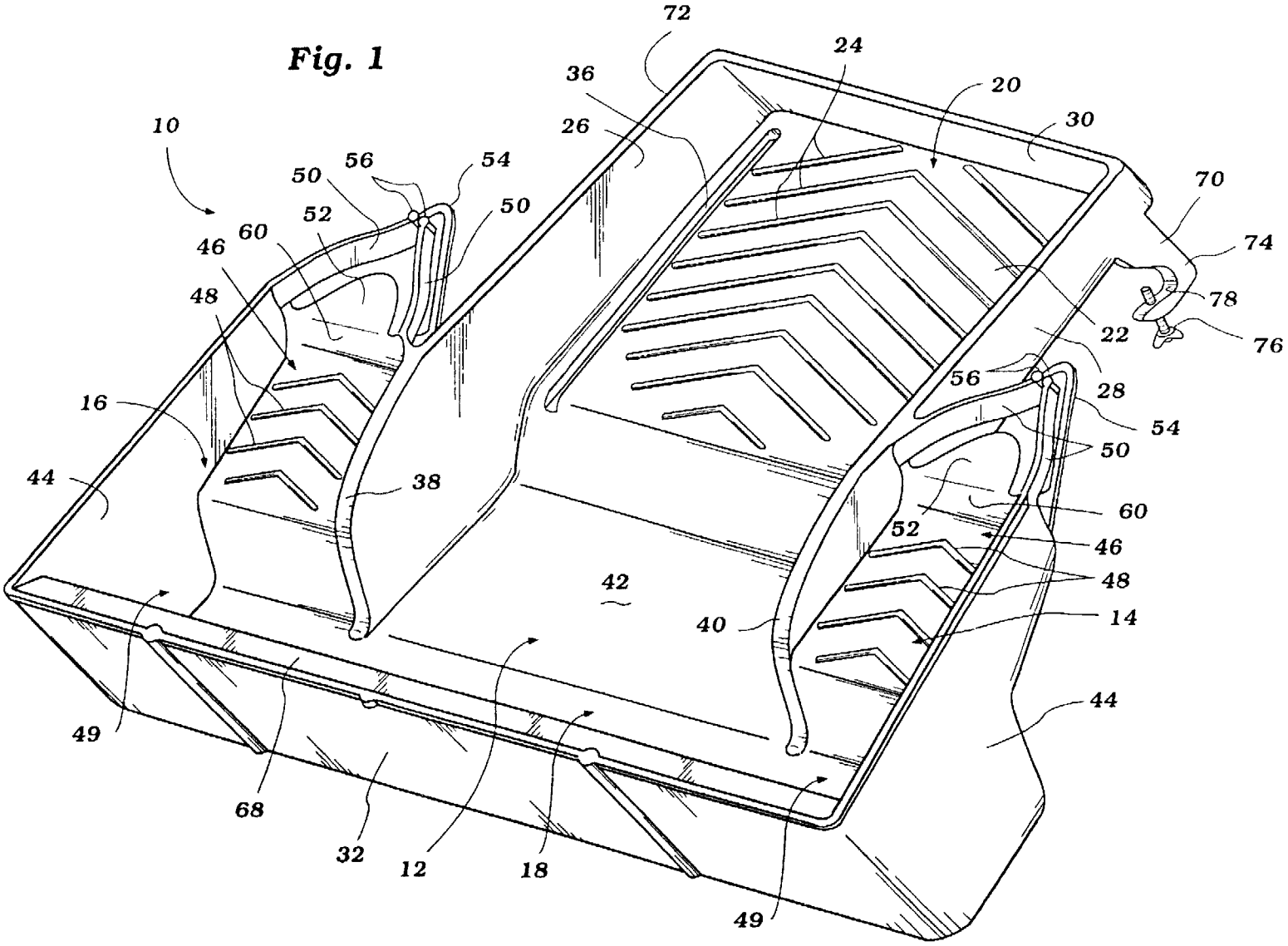
FIG. 1 is a pictorial view of the paint tray of the present invention.
Figure 2:
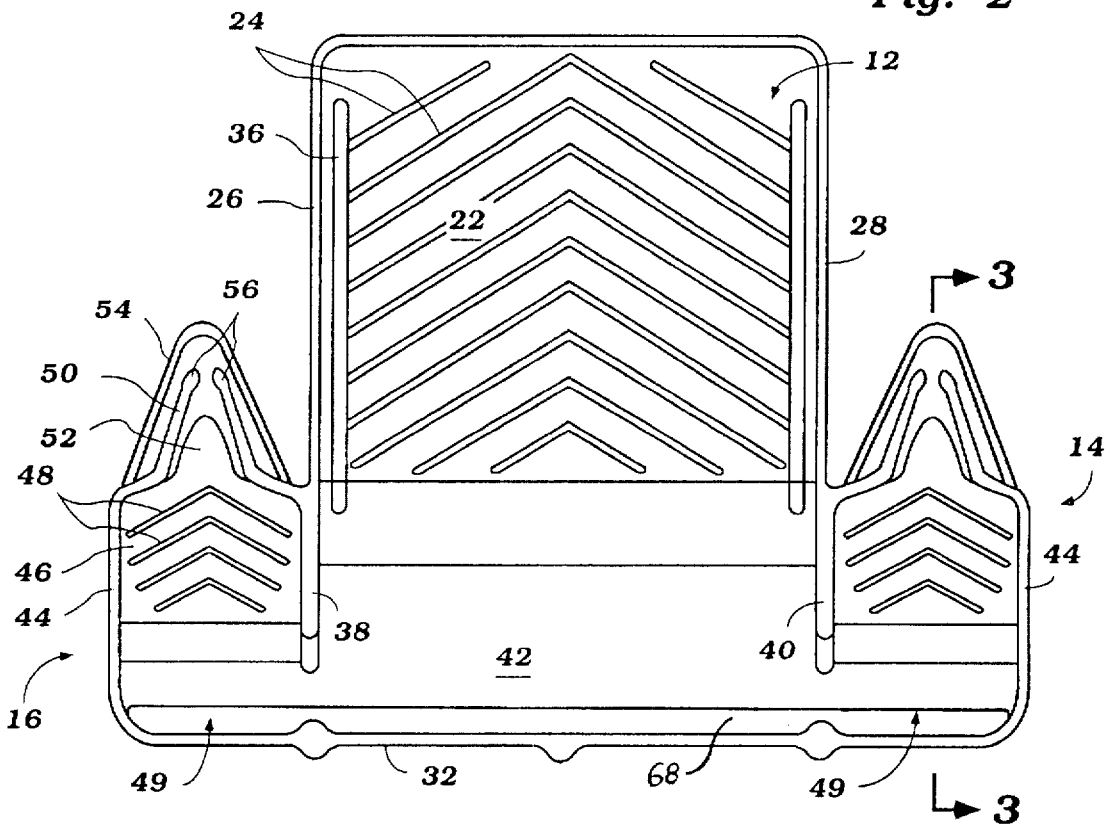
FIG. 2 is a plan view of the paint tray of FIG. 1.
Figure 3:
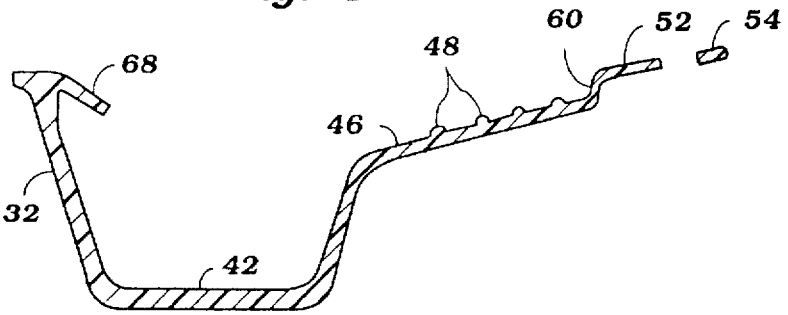
FIG. 3 is a sectional view taken along the line 3—3 of FIG. 2, showing the design of one of the side paint wells of the paint tray of FIG. 1.
Figure 4:
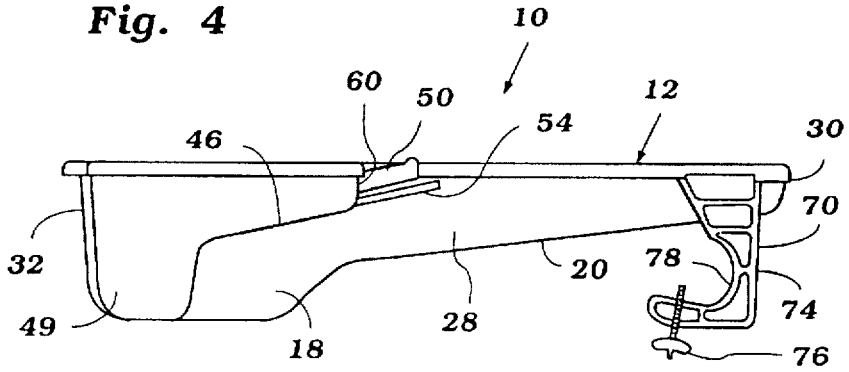
FIG. 4 is a side view of the paint tray of FIG. 1.

Referring now to the figures, the present invention comprises a paint tray 10 that includes a main paint well section 12 and a pair of side paint well trays 14, 16. Main paint well section 12 includes a deep end 18 and a shallow end 20 similar to a conventional paint roller tray. Shallow end 20 includes a sloped floor 22 that has a series of ribs 24 that are angled from the center of the main paint well section outwardly and forwardly to the sides of the main paint well. Ribs 24 assist in removing paint from a paint roller as the roller is rolled in shallow end 20. Main paint well section 12 is defined by a pair of sidewalls 26, 28, a back wall 30 and a front wall 32. Front wall 32 is wider than back wall 30 and extends laterally outwardly to the outer side boundaries of side paint wells 14, 16. The sloped floor 22 of shallow end 20 further includes a pair of channels 36 (only one shown), each channel running along the outer side edge of sloped floor 22. The top edges 38, 40 of sidewalls 26, 28 slope downwardly to the floor pan 42, which defines the floor of deep end 18 of main paint well 12. Sidewalls 26, 28 terminate at a point spaced inwardly from front wall 32, allowing floor pan 42 to extend outwardly into side paint wells 14, 16.

Each side paint well 14, 16 is a mirror image of the other. Each includes an outer sidewall 44, a shallow sloped shelf 46, and a deep well area 49. Deep well areas 49 are contiguous with deep well end 18 to allow paint in deep well areas 49 to mix with paint in deep well end 18. The sloped shelf 46 includes ribbing 48, similar to the ribbing 24 of shallow end 20. Side paint wells 14, 16 are aligned generally parallel to main paint well 12 but, as an alternative design, could extend outwardly at a right angle to the main paint well. The parallel arrangement is more compact and easier to use.

Each side paint well 14, 16 further includes a pair of spring tines or clamps 50 for gripping a handle of a paint brush, paint roller or some other type of painting instrument. Spring tines 50 converge from side walls 26, 28 and outer sidewalls 44, at an angle until their distal ends are spaced in close proximity to one another. An inner ledge 52 is defined between spring tines 50 and an outer V-shaped ledge strip 54 extending around the outer perimeter of spring tines 50. The design of spring tines 50, inner ledge 52 and outer ledge strip 54 are disclosed in more detail in my U.S. Pat. No. 4,993,671, entitled "Paint Brush Holder", issued Feb. 19, 1991. A significant improvement on the paint brush holder disclosed in my prior U.S. Patent is shown is FIG. 1. Each spring tine 50 includes at its outer distal end a knobule 56, which is a rounded protuberance that functions to hold down the handle of a paint brush or paint roller against ledges 52, 54.

Inner ledge 52 and shelf 46 of each side paint well form a shoulder 60, as best shown in FIG. 5. Shoulder 60 prevents paint from dripping outwardly past ledge 52.

A pair of ladder clamps 70, 72 are mounted on the outer sides of sidewalls 26, 28, at the shallow end 20 thereof. Each ladder clamp 70 includes an L-shaped leg 74 and a wing bolt 76. Wing bolt 76 is threadably mounted in leg 74, to clamp the rung of a ladder into the recess section 78 of leg 74.

The main paint well 12 is designed to accommodate a supply of paint in the deep well section 18, and the sloped floor 22 of the shallow end 20 is designed to allow for the application of paint to the roller pad of a paint roller in a manner well understood by those skilled in the art.

Side paint wells 14, 16 are each designed to accommodate either a paint brush or a small paint roller, preferably a roller or brush approximately 3 to 5 inches in width. Ribs 48 and shelves 46, likewise, assist in applying paint to a paint roller pad.

The front wall 32 of paint tray 10 includes an inwardly and downwardly directed flange 68, which extends the entire width of paint tray 10. Flange 68 acts as a wiper for a paint brush to remove excess paint from the brush.

An important feature of the invention is that the deep well area 49 of the side paint wells 14, 16 and the deep end 18 of the main paint well 12 are joined together so that paint from the side paint wells mixes with paint in the main paint well area. In this manner, a painter can use a paint roller and a paint brush (or two paint rollers) with a common supply of paint, thus helping to ensure uniform color application.

Paint tray 10 is made as a single, one-piece unit from a lightweight material, such as plastic, with the exception of wing bolts 76, which can be secured to legs 74 after the paint tray is manufactured.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. A paint tray, comprising:

a) a main paint well having a deep end and a shallow end, with sidewalls defining the main paint well, the shallow end designed to remove paint from a paint roller as the paint roller is rolled in the shallow end, the deep end designed to hold a quantity of paint into which a paint roller can be dipped;

b) a side paint well having a deep end and a shallow end, adjacent the deep end of the main paint well, the side paint well including a deep well area contiguous with the deep end of the main paint well;

c) the main paint well and the side paint well formed as a single, one-piece unit from a plastic material; and d) a paint instrument holder, fixed to the side paint well, for gripping a handle of a painting instrument.

2. The paint tray of claim 1, wherein the paint instrument holder includes a spring clamp for gripping a handle of a paint instrument.

3. The paint tray of claim 2, wherein the spring clamp includes a pair of tines, each tine having a knobule at its distal end, for holding a paint instrument down on the holder.

4. The paint tray of claim 1, wherein the side paint well is aligned parallel to the main paint well with the paint instrument holder adjacent a sidewall of the main paint well.

5. The paint tray of claim 1, and further comprising a second side paint well, the first and second side paint wells being positioned on opposite sides of the main paint well, the second paint well including a paint instrument holder and a deep well area contiguous with the deep end of the main paint well.

6. The paint tray of claim 5, wherein the first and second side paint wells are oriented parallel to the main paint well, with the paint brush holder of each side well adjacent a sidewall of the main paint well.

7. The paint tray of claim 1, and further comprising a clamp at the shallow end of the main paint well for securing the main paint well to a rung of a ladder.

8. The paint tray of claim 1, wherein the side paint well includes a shallow end designed to remove paint from a second paint roller as the second paint roller is rolled in the shallow end, said shallow end terminating with and contiguous with the deep well area, and wherein said second paint roller can be dipped in the deep well area and paint removed from said second paint roller in the shallow end of the side paint well in order to apply paint to the second paint roller.

9. The paint tray of claim 1, wherein the paint instrument holder is formed as a part of said single, one-piece unit from a plastic material of the paint tray.

10. A paint tray, comprising:

a) a main paint well having a deep end and a shallow end, with sidewalls defining the main paint well, the shallow end having a sloped floor and including a series of ribs designed to remove paint from a first paint roller as the first paint roller is rolled in the shallow end, the deep end designed to hold a quantity of paint into which a paint roller can be dipped, wherein said roller can be dipped in the deep well area and paint removed from said second paint roller in the shallow end of the side paint well in order to apply paint to the second paint roller; and b) a side paint well adjacent the deep end of the main paint well, the side paint well including a deep well area contiguous with the deep end of the main paint well and a shallow end having a sloped floor and including a series of ribs designed to remove paint from a second paint roller as the second paint roller is rolled in the shallow end, said shallow end terminating with and contiguous with the deep well area, wherein said roller can be dipped in the deep well area where the deep well area and paint removed from said second paint roller in the shallow end of the side paint well in order to apply paint to the second paint roller.

11. The paint tray of claim 10, and further comprising a paint instrument holder including a spring clamp for gripping a handle of a paint instrument.

12. The paint tray of claim 11, wherein the spring clamp includes a pair of tines, each tine having a knobule at its distal end, for holding a paint instrument down on the holder.

13. The paint tray of claim 10, wherein the side paint well is aligned parallel to the main paint well.

14. The paint tray of claim 10, and further comprising a second side paint well, the first and second side paint wells being positioned on opposite sides of the main paint well, the second paint well including a deep well area contiguous with the deep end of the main paint well.

15. The paint tray of claim 14, wherein the first and second side paint wells are oriented parallel to the main paint well.

16. The paint tray of claim 10, and further comprising a second side paint well, the first and second side paint wells being positioned on opposite sides of the main paint well, the second paint well including a paint instrument holder and a deep well area contiguous with the deep end of the main paint well.

17. The paint tray of claim 16, wherein the first and second side paint wells are oriented parallel to the main paint well, with the paint brush holder of each side well adjacent a sidewall of the main paint well.

18. The paint tray of claim 10, and further comprising a clamp at the shallow end of the main paint well for securing the main paint well to a rung of a ladder.

* * * * *